US006110067A

United States Patent [19]

Nuttall

[11] Patent Number: 6,110,067

[45] Date of Patent: Aug. 29, 2000

[54] METHOD AND APPARATUS FOR SERVICING AUTOMATIC TRANSMISSIONS

[76] Inventor: Robert D. Nuttall, 211 Stocker Ave., King of Prussia, Pa. 19406

[21] Appl. No.: 09/281,178

[22] Filed: Mar. 30, 1999

[51] Int. Cl.[7] ..... B25B 13/00

[52] U.S. Cl. ..... 475/146; 81/58.1; 81/55

[58] Field of Search ..... 475/146; 188/69; 173/216, 178, 48; 81/58.1, 55, 13, 9.24

[56] References Cited

U.S. PATENT DOCUMENTS

| | | | |
|---|---|---|---|
| 956,467 | 4/1910 | Anderson | 81/55 |
| 2,772,590 | 12/1956 | Werries | 81/55 |
| 3,086,414 | 4/1963 | Nardi | 81/176.1 |
| 3,554,057 | 1/1971 | Michnay | 475/146 |
| 3,889,558 | 6/1975 | Duncan | 81/55 |
| 4,630,510 | 12/1986 | Belanger | 81/55 |
| 4,836,062 | 6/1989 | LaTorre | 81/55 |

OTHER PUBLICATIONS

Catalog: "Special Service Tools", Mitsubishi Motors, 1997.

*Primary Examiner*—Sherry L. Estremsky
*Assistant Examiner*—Ha Ho
*Attorney, Agent, or Firm*—William H. Eilberg

[57] ABSTRACT

An automatic transmission is adjusted by changing the longitudinal position of a pin relative to a hydraulically-actuated piston, the pin being threaded into the piston. A holding socket engages the piston and prevents it from rotating while the pin is being adjusted. The holding socket engages a support guide which is contained within the transmission casing. The combination of the holding socket and the support guide replaces a spanner wrench, used in the prior art, and eliminates the need to disassemble the transmission to perform the adjustment, and also provides a more convenient way of making the adjustment in the cramped environment of an automatic transmission. The process therefore substantially reduces the time required to adjust an automatic transmission, and also reduces the likelihood of harm to the transmission, or injury to the technician, during the adjustment process.

5 Claims, 11 Drawing Sheets

METHOD AND APPARATUS FOR SERVICING AUTOMATIC TRANSMISSIONS

BACKGROUND OF THE INVENTION

This invention relates to the field of servicing of automatic transmissions for automobiles, and provides a device which substantially reduces the time required to adjust such transmissions, and also increases the accuracy of the adjustment. The invention can also be used in other fields.

In an automotive automatic transmission, it periodically becomes necessary to adjust the kickdown band. The kickdown band is a component which, when actuated by a hydraulically operated piston connected to a threaded pin, is pressed by the pin against a kickdown drum and stops the rotation of the drum. The kickdown band tends to wear after prolonged use, and it becomes necessary to adjust the position of the pin so that actuation of the piston will cause the kickdown band to move to the desired position.

Making the above adjustment, in the prior art, is difficult, because the various components are concentrically mounted in a cramped enclosure. Because the pin is threadedly connected to the piston, it is very difficult to adjust the pin while preventing the piston from rotating.

The prior art has attempted to solve the above problem by providing a spanner wrench which prevents the piston from rotating while the pin is adjusted. But the spanner wrench itself causes other problems. The handle of the spanner wrench is difficult to hold in the cramped environment surrounding the transmission. Moreover, to insure that the piston does not turn when the pin is being adjusted, it is necessary to mount the handle of the spanner wrench to the transmission casing, and this step makes the entire process more complex and unreliable. In some cases, the transmission casing may be damaged when using this prior art technique. Moreover, even when the spanner wrench is temporarily affixed to the transmission casing by a threaded connection, it is likely to disengage from the piston and often must be held by hand anyway.

The present invention solves the problems described above, by providing an apparatus and method which eliminate the need for the spanner wrench described above. The present invention substantially reduces the time required to adjust an automatic transmission, increases the accuracy of the adjustment, and reduces the likelihood of damage to the transmission casing, and bodily injury to the technician, while making the adjustment.

SUMMARY OF THE INVENTION

The present invention is especially intended for use in an automatic transmission for an automobile. The major components of the transmission, which are relevant to the problem solved by the present invention, include a servo piston which is threadedly connected to a pin, called the "servo apply pin". Longitudinal movement of the servo apply pin, when the servo piston is actuated by external hydraulic pressure, causes a kickdown band to press against a drum and to stop the rotation of the drum. The aim of the present invention is to adjust the longitudinal position of the servo apply pin, without allowing the servo piston to turn, so that the servo apply pin reaches the correct position when the servo piston is actuated.

The present invention achieves the above objective by providing a holding socket and a support guide. The holding socket includes a plurality of lugs which engage similarly shaped cutouts formed on the servo piston. The support guide is a generally cylindrical structure, into which the holding socket fits. The support guide is held within the casing by a lock ring, and prevents the holding socket from falling out of engagement with the piston.

With the support guide and the holding socket engaged with each other, and with the holding socket in engagement with the lugs on the servo piston, it becomes easy to make the necessary adjustments. Insertion of a lock nut socket, which fits through center bores of the support guide and the holding socket, facilitates the loosening and tightening of a lock nut which holds the servo piston and servo apply pin in place. Insertion of an adjusting tool, also through the center bores of the support guide and the holding socket, as well as through a center bore in the lock nut socket, facilitates the engagement and adjustment of the servo apply pin. The servo apply pin is adjusted simply by turning it so that it screws inwardly or outwardly, while the servo piston is held in place and does not turn. In this way, the longitudinal position of the servo apply pin can be adjusted.

In an alternative embodiment, the holding socket and support guide can be integrally formed.

Another aspect of the invention is that it comprises a kit which includes components necessary to adjust the transmission. At a minimum, the kit includes the holding socket and support guide, or an integral structure which combines these two components.

The present invention has the advantage that it facilitates adjustment of the servo apply pin without the need to affix a wrench to the transmission casing. Substantially all of the operations can be performed by adjustment of various components which are arranged concentrically, and without having to remove and reinstall various components of the transmission.

The present invention therefore has the primary object of providing an apparatus and method for adjusting an automatic transmission in an automobile.

The invention has the further object of providing an apparatus and method as described above, wherein it is not necessary to remove components of the transmission when performing the adjustment.

The invention has the further object of reducing the time necessary to adjust an automatic transmission.

The invention has the further object of reducing the likelihood of damage to an automatic transmission when the transmission is being adjusted.

The invention has the further object of reducing the likelihood of personal injury while adjusting an automatic transmission.

The invention has the further object of facilitating the adjustment of an automatic transmission, wherein the components of the transmission are mounted in a cramped environment.

The invention has the further object of providing a kit for adjusting an automatic transmission.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
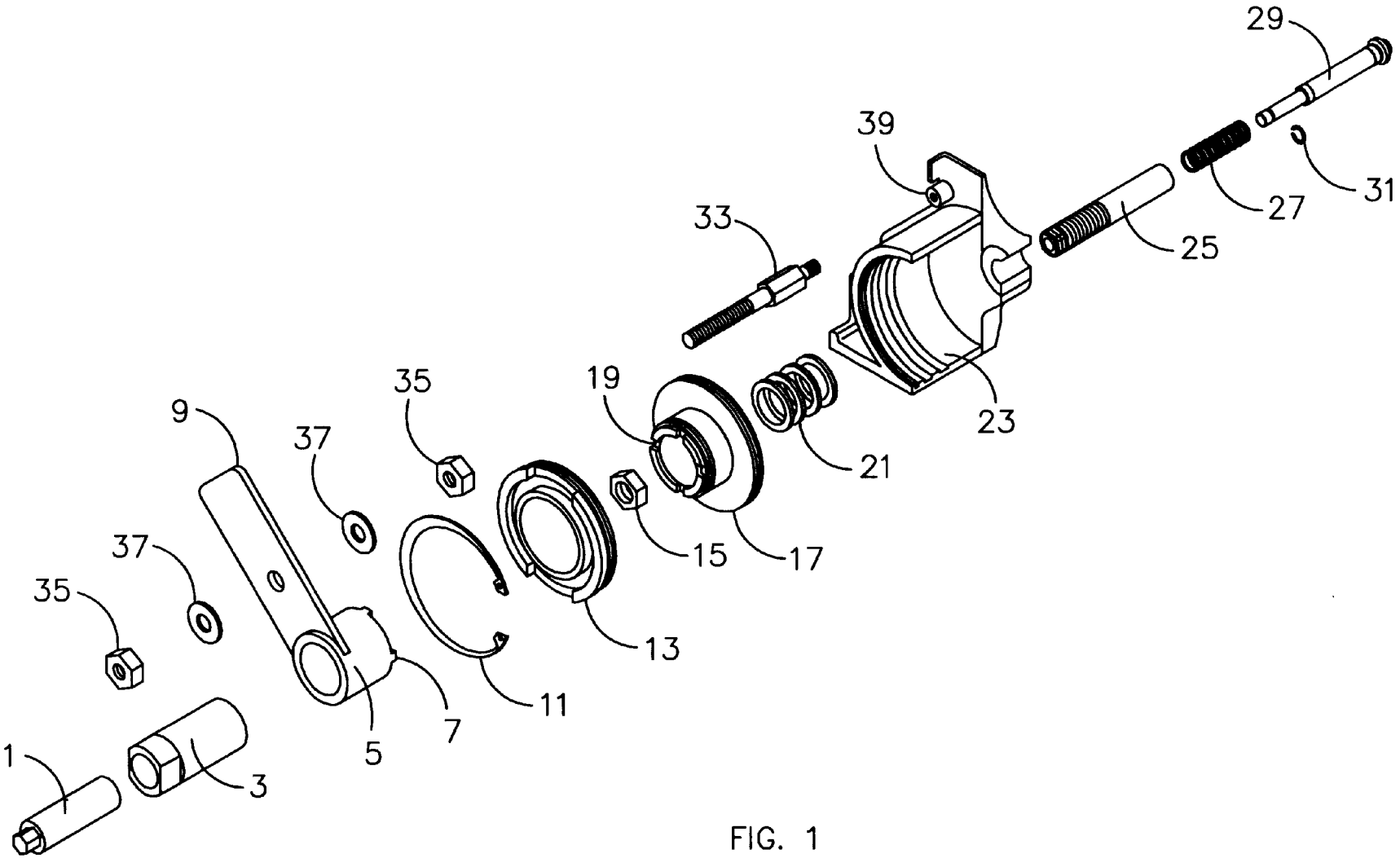
FIG. 1 PRIOR ART
FIG. 1 provides an exploded perspective view of an arrangement used, in the prior art, for adjusting a kickdown band of an automatic transmission, the figure showing the transmission casing in fragmentary form.
Figure 2:
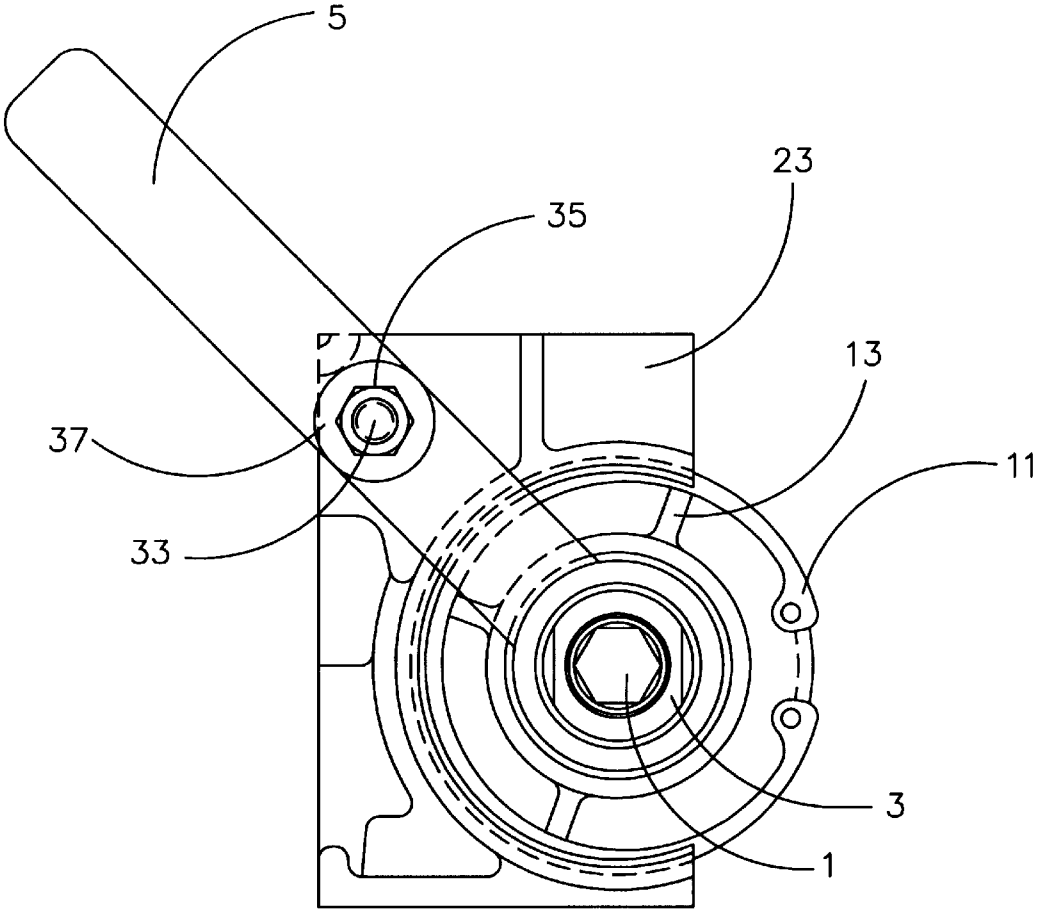
FIG. 2 PRIOR ART
FIG. 2 provides an end view of the prior art device of FIG. 1.
Figure 3:
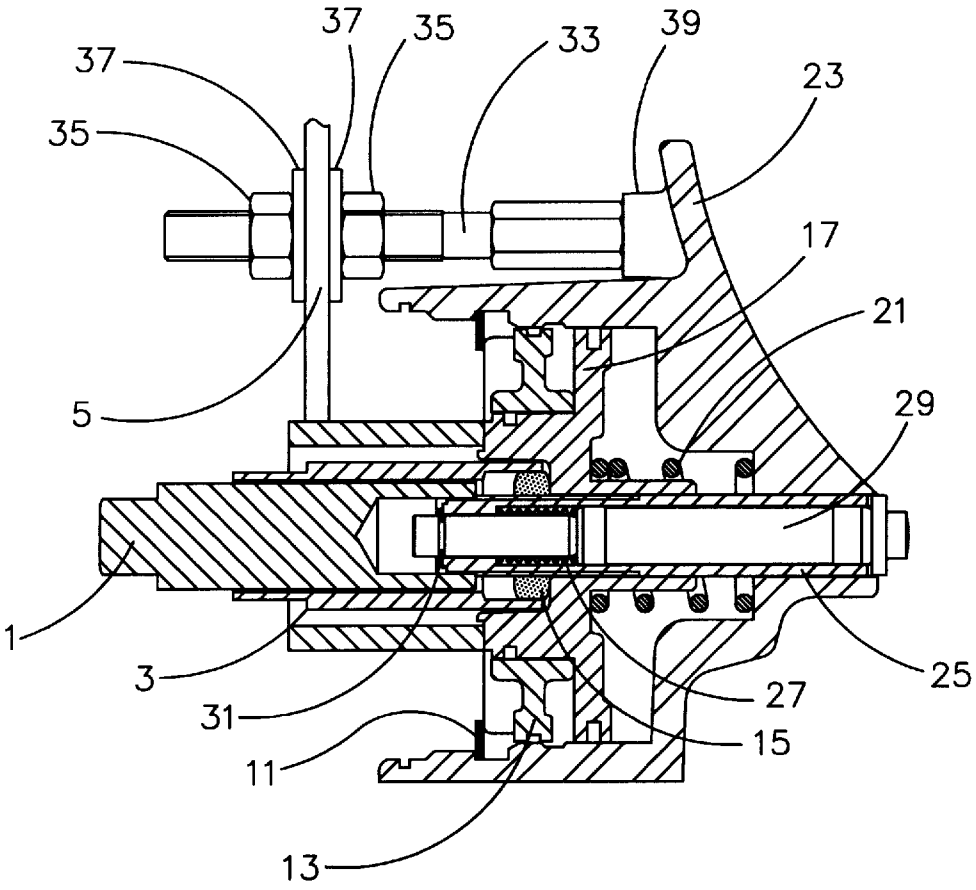
FIG. 3 PRIOR ART
FIG. 3 provides a partial longitudinal cross-section of the prior art device of FIG. 1.

An understanding of the present invention depends critically on an understanding of the corresponding device of the prior art. FIGS. 1–3 illustrate the prior art device, which is explained below.

The ultimate purpose of the device shown in FIGS. 1–3 is to adjust the longitudinal position of servo apply pin 25 relative to servo piston 17. Such adjustment determines how far pin 25 will extend when piston 17 moves to the right in FIG. 1, under the influence of a source of hydraulic pressure (not shown).

The servo apply pin 25 threads into servo piston 17. The servo apply pin has four flat surfaces machined across its threaded end, as shown. When the kickdown band (not shown) is to be moved, the servo piston 17 pushes the servo apply pin 25 against a lug (not shown) on the kickdown band. This action causes the kickdown band to clamp tightly onto the outer diameter of a kickdown drum (not shown) and stops the drum from rotating.

The servo piston 17 is housed within casing 23, shown broken away in FIG. 1. Servo piston return spring 21 is used to return the servo piston to the retracted position when hydraulic pressure is not being applied to the servo piston. Servo piston guide 13 is used to guide the servo piston 17 in its bore as it moves under the influence of hydraulic pressure. Lock ring 11 retains the servo piston guide and servo piston within the casing 23.

The servo apply pin 25 acts through servo apply pin plunger 29, which fits through return spring 27. The plunger 29 and return spring 27 are mounted into the servo apply pin 25 with the aid of plunger lock ring 31. The lock ring fits into a lock ring groove on the servo apply pin plunger 29, and serves to retain the plunger and spring in the servo apply pin 25. The return spring keeps the plunger fully extended when no hydraulic pressure is applied to the piston 17.

Lock nut 15 threads onto servo apply pin 25, and holds the servo apply pin at the correct position, relative to the piston 17, after the adjustment has been performed.

As shown most clearly in FIG. 1, the servo piston 17 includes a flange having four slotted cutouts 19. These cutouts mate with lugs 7 formed on spanner wrench 5. The spanner wrench holds the servo piston stationary, and prevents the piston from rotating, when the lock nut 15 is being loosened or tightened. The spanner wrench includes a long outwardly-extending handle 9.

The handle of the spanner wrench is affixed to the casing 23, by means of anchor rod 33 and jam nuts 35 and washers 37. The anchor rod has a long threaded end and a short threaded end. A hexagonal-shaped member is machined between these threaded ends. The hexagonal member is used to tighten the anchor rod into the transmission case. The short threaded end threads into threaded boss 39, which is an extension of casing 23. The long threaded end slides through a hole in the handle of the spanner wrench. Jam nuts 35 thread onto the anchor rod 33, to hold the spanner wrench stationary. Washers 37 fit between each jam nut and the spanner wrench, and provide a relatively large surface against which the jam nuts can press.

Lock nut socket 3 is used to loosen and tighten the lock nut 15, to allow the position of the servo apply pin 25 to be adjusted. On one end (the left end, as shown in FIG. 1), the lock nut socket has two large flat surfaces machined onto its external surface. On the other end, the lock nut socket has an internally machined hexagonal shape (not visible in FIG. 1) which mates with lock nut 15.

Adjusting tool 1 performs the actual adjustment which is the object of the prior art device. The adjusting tool has a hexagonal shape at one end (the left end as shown in FIG. 1). On the other end, the tool has internal threads (not visible in FIG. 1) which match the round threaded portion of servo apply pin 25.

The operation of the prior art device shown in FIGS. 1–3 will now be described.

As a preliminary step, one must remove a plastic cover (not shown) to provide access to the internal components of the transmission. One then affixes the spanner wrench to the casing, as shown. This step will require removal of a bolt (not shown) which has been previously installed in threaded boss 39. One threads the short threaded end of anchor rod 33 into the threaded boss 39. One then threads one of the jam nuts 35 all the way onto the long threads of anchor rod 33. One slides one of the flat washers 37 onto the anchor rod until the washer seats on the jam nut.

Next, one positions the spanner wrench such that its four lugs 7 engage the four slotted cutouts 19 on the servo piston 17, such that the handle 9 of the spanner wrench 5 assumes the position shown in the figures. Also, note that the handle of the spanner wrench is approximately aligned with the threaded boss 39, and thus with the anchor rod 33.

Next, one carefully rotates the servo piston 17 and the spanner wrench 5, so that the hole in the spanner wrench is exactly aligned with anchor rod 33, and so that the lugs 7 on the spanner wrench remain engaged with the cutouts 19 on servo piston 17. During this process, the lugs and the cutouts may become momentarily disengaged, as the spanner wrench is turned so that its hole is aligned with anchor rod 33. If they become disengaged, one must re-engage them.

While holding the spanner wrench with one hand, with the lugs engaged in the cutouts, one threads the inside jam nut 35 outward, using the other hand, until the washer seats against the handle of the spanner wrench. Next, one installs the other washer and jam nut, located on the other side (the left-hand side in FIG. 1) of the handle of the spanner wrench. The jam nuts 35 are tightened with a conventional wrench (not shown). At this point, the handle of the spanner wrench is attached to the casing 23.

One then slides the lock nut socket 3 into the center bore of the spanner wrench, so that the two large flat surfaces of the lock nut socket face away from the spanner wrench, as illustrated most clearly in FIG. 1. The internal hexagonal end of the lock nut socket must face into the spanner wrench so that it can engage the lock nut 15.

Holding the handle of the spanner wrench stationary, and keeping a conventional wrench (not shown) engaged on the two large flat surfaces of the lock nut socket, will prevent the servo piston 17 from rotating. At the same time, still with a conventional wrench engaging the two flat surfaces of the lock nut socket 3, the lock nut 15 can be loosened or tightened without rotation of the servo piston 17.

Next, one slides the adjusting tool 1 into the center of the lock nut socket 3, with the external hexagonal end facing away from the lock nut socket, i.e. with the orientation shown in FIG. 1. One threads the adjusting tool about three threads onto the end of the servo apply pin 25. Note that the lock nut 15 is threaded onto servo apply pin 25, and thereby acts as a stop for adjusting tool 1 when the latter is also threaded onto the servo apply pin 25. Next, one turns lock nut socket 3 so as to unscrew lock nut 15 from servo apply pin 25. The lock nut socket grasps the lock nut around its periphery.

Next, while holding the adjusting tool 1 with a conventional wrench, on its hexagonal end (the left-hand side as shown in FIG. 1), one turns the lock nut socket 3 to tighten the lock nut 15 against the adjusting tool 1. At this point, the lock nut 15 is still threaded on servo apply pin 25, and acts as a stop for adjusting tool 1. Now, the servo apply pin 25 is effectively locked to the adjusting tool 1. Rotating the adjusting tool 1 will rotate the servo apply pin 25, and will thereby move the servo apply pin longitudinally, to the right or the left in FIG. 1, so that the servo apply pin reaches the desired position upon actuation of the piston.

The above explanation shows the difficulty inherent in the arrangement of the prior art. It is difficult to hold the servo piston 17, and to prevent it from rotating, while loosening or tightening the lock nut 15. Use of the spanner wrench prevents such unwanted rotation, but the spanner wrench is awkward for the following reasons. First, the wrench handle extends outwardly in an inconvenient position. In the cramped space in the vicinity of an automatic transmission, it is difficult to reach the handle of the spanner wrench, and to attach it to the casing. Manipulating the anchor rod in its cramped environment is also difficult. Even when the spanner wrench handle is successfully affixed to the casing, the anchor rod may flex, causing the spanner wrench to fall out of engagement with the cutouts. Thus, it is often necessary to hold the spanner wrench with one hand, even though it has been screwed into the casing. Also, if the mechanic is not careful in threading the anchor rod, the transmission casing can be damaged, requiring replacement of the casing.

The ultimate purpose of the device of the present invention, shown in FIGS. 4–8 is the same as that of the prior art, namely to adjust the longitudinal position of a servo apply pin relative to the servo piston. Similar to the arrangement of the prior art, the servo apply pin 77 threads into servo piston 69. The servo apply pin and servo piston have the same construction as in the prior art.

As in the prior art, the servo piston 69 of the present invention is housed within casing 75, and return spring 73 is used to return the servo piston to the retracted position when hydraulic pressure is removed. Servo piston guide 65 guides the servo piston 69 in its bore, and lock ring 63 retains the servo piston guide and servo piston within the casing 75.

The action of the servo apply pin 77 is the same as in the prior art. Servo apply pin 77 actuates plunger 81, which fits through return spring 79. The plunger and return spring are mounted in servo apply pin 77 with the aid of plunger lock ring 83. The components described above have the same structure and function as those of the prior art device.

Figure 4:
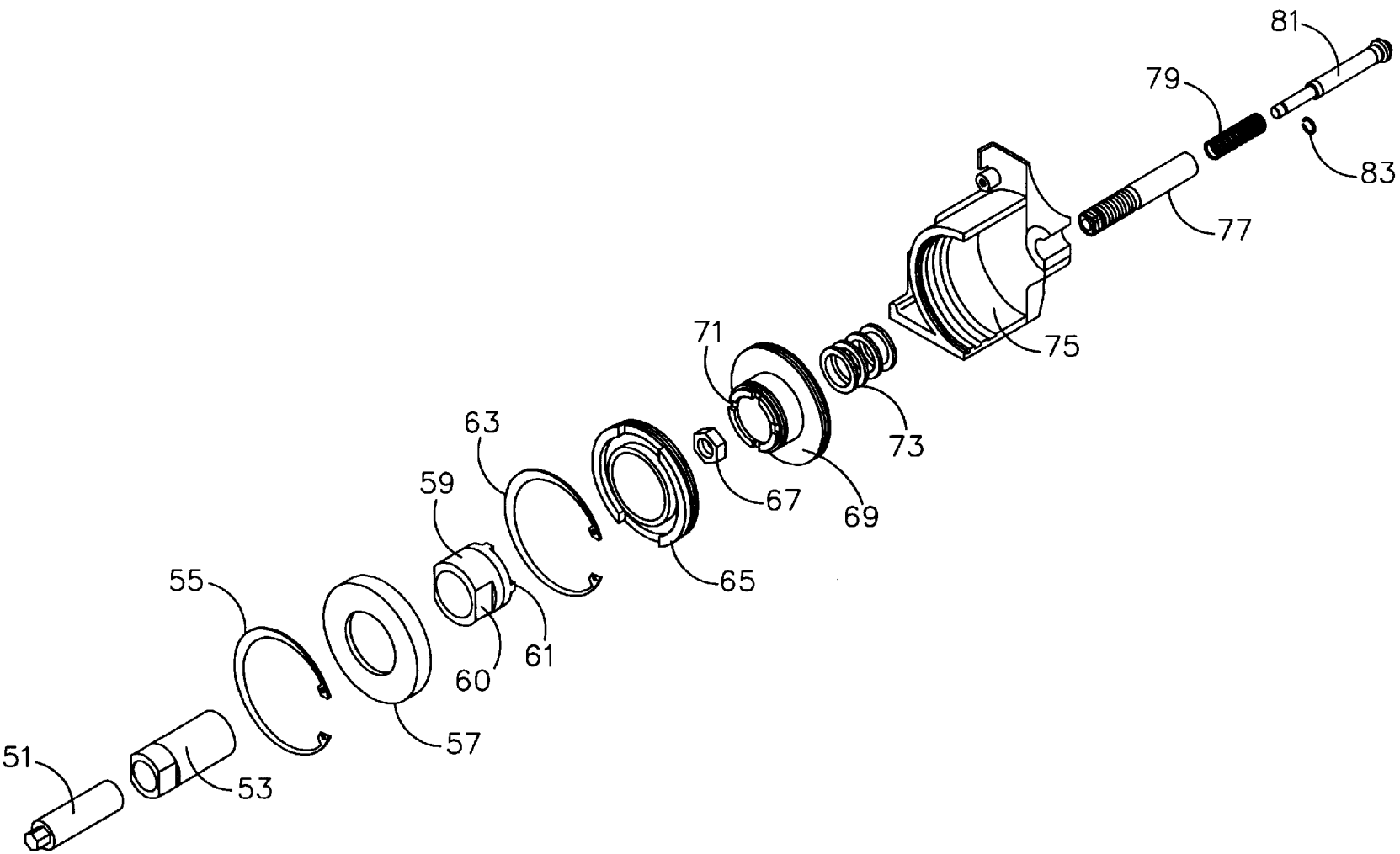
FIG. 4 provides an exploded perspective view of the apparatus of the present invention, showing the transmission casing in fragmentary form.
Figure 5:
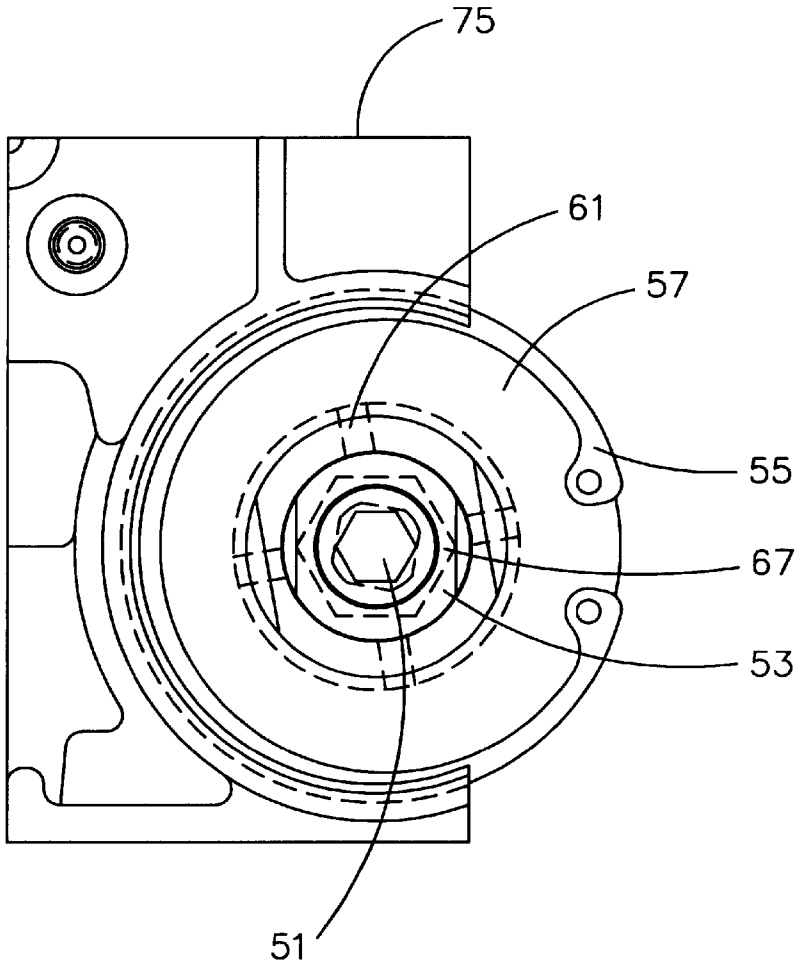
FIG. 5 provides an end view of the apparatus of the present invention.
Figure 6:
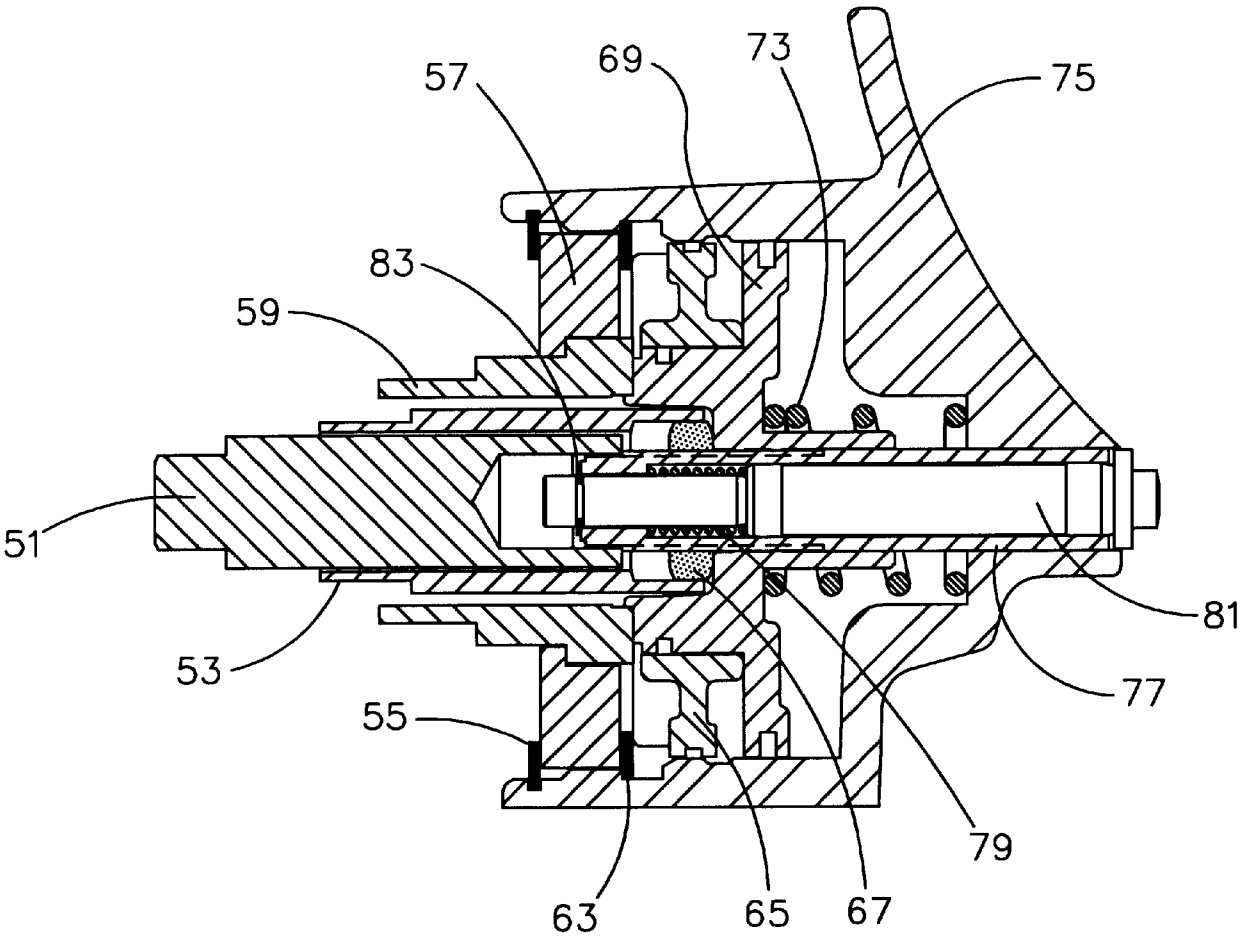
FIG. 6 provides a longitudinal cross-section of the apparatus of the present invention.

The end of the servo apply pin which is nearer to the servo piston has a polygonal cross-section. In the preferred embodiment, the end of the servo apply pin is generally square, as shown in FIG. 4. This square end mates with the adjusting tool 51, to be described later.

The relationship of the lock nut 67 to the servo apply pin 77 is the same as in the prior art. Lock nut 67 threads onto servo apply pin 77, and holds the servo apply pin at the correct position, relative to the piston 69, after an adjustment has been performed.

As shown most clearly in FIG. 4, the servo piston 69 includes a flange having four slotted cutouts 71. These cutouts mate with corresponding lugs 61 formed on servo piston holding socket 59. The holding socket is used to hold the servo piston stationary, and prevent it from rotating when the lock nut 67 is being loosened or tightened. The holding socket is generally tubular in shape, and has a hole bored through its center. It has a flange (not shown in FIG. 4) machined into the outside diameter, on the same end that has the lugs. The flange is intended to sit on a corresponding flange seat in support guide 57. On the end of the holding socket opposite to the lugs, there are two large, flat surfaces 60 that are machined 180° across the tubular-shaped socket, as illustrated in FIG. 4. Only one of the surfaces 60 is visible in FIG. 4.

The support guide 57 is used to retain the holding socket 59 within casing 75, and positively holds lugs 61 within cutouts 71. Note that support guide 57 and holding socket 59 are not prevented from rotating relative to each other. The support guide comprises a round, thick disk, with a large hole bored through the center. On the front side, more clearly illustrated in the cross-sectional view of FIG. 8*a*, it has a counter bore 62 in the center of the disk, and a flange seat 64 at the bottom of the counter bore, and a wide, flat surface 66 on the outer perimeter. On the back side, the support guide has a wide and flat surface 68. The surface 68 is what is visible in FIG. 4.

Lock ring 63 retains the servo piston guide and servo piston within its bore in the casing. Lock ring 55 retains the support guide within the servo piston bore.

Figure 9:
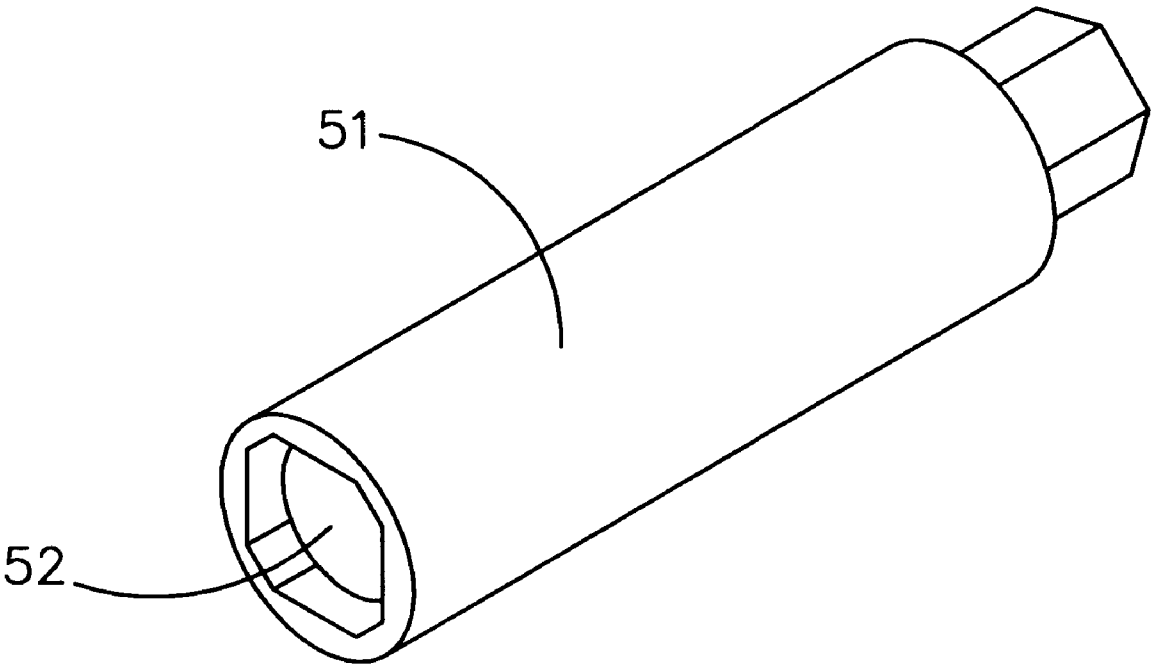
FIG. 9 provides a perspective view of the adjusting tool forming part of the present invention, showing a shaped recess which engages a similarly shaped pin.

Adjusting tool 51 is similar to the adjusting tool of the prior art, except that it has an internally machined polygonal recess which mates with the polygonal end of the servo apply pin. In the preferred embodiment, the polygon is a square. The latter structure is more clearly shown in the perspective view of FIG. 9, which is taken from a direction opposite to that shown in FIG. 4. FIG. 9 clearly shows a generally square recess 52 which mates with the square end of the servo apply pin.

Lock nut socket 53 is similar to the corresponding element in the prior art device.

Figure 7C:
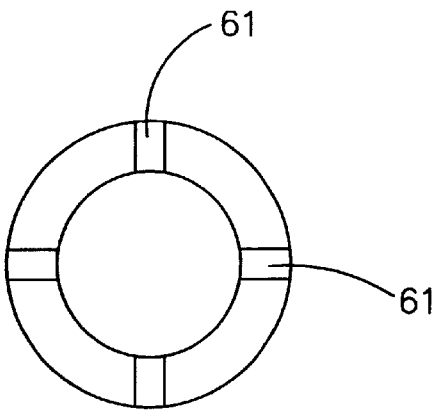
FIGS. 7*a*, 7*b*, and 7*c* provide front, side, and rear elevational views of the servo piston holding socket of the present invention.
Figure 7B:
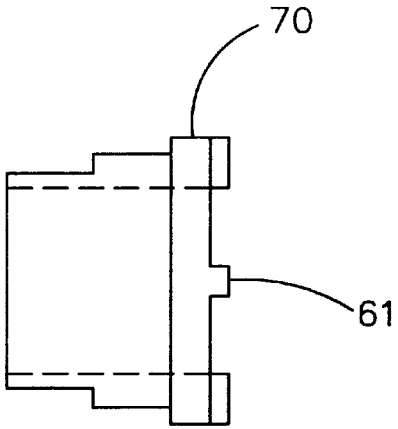
Figure 7A:
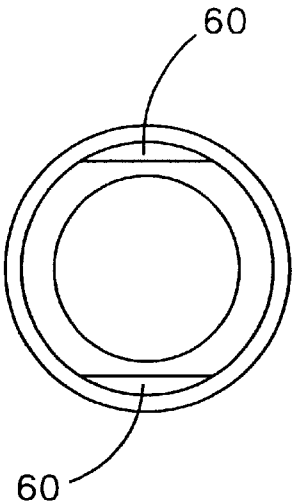

FIGS. 7*a*, 7*b*, and 7*c* provide additional details concerning the holding socket. FIG. 7*a* is a rear elevational view, FIG. 7*b* is a side elevational view, and FIG. 7*c* is a front elevational view. FIG. 7*b* explicitly illustrates flange 70 which seats in the corresponding recess in the support guide. FIG. 7*a* shows flat surfaces 60. Both FIGS. 7*b* and 7*c* show the lugs 61.

Figure 8B:
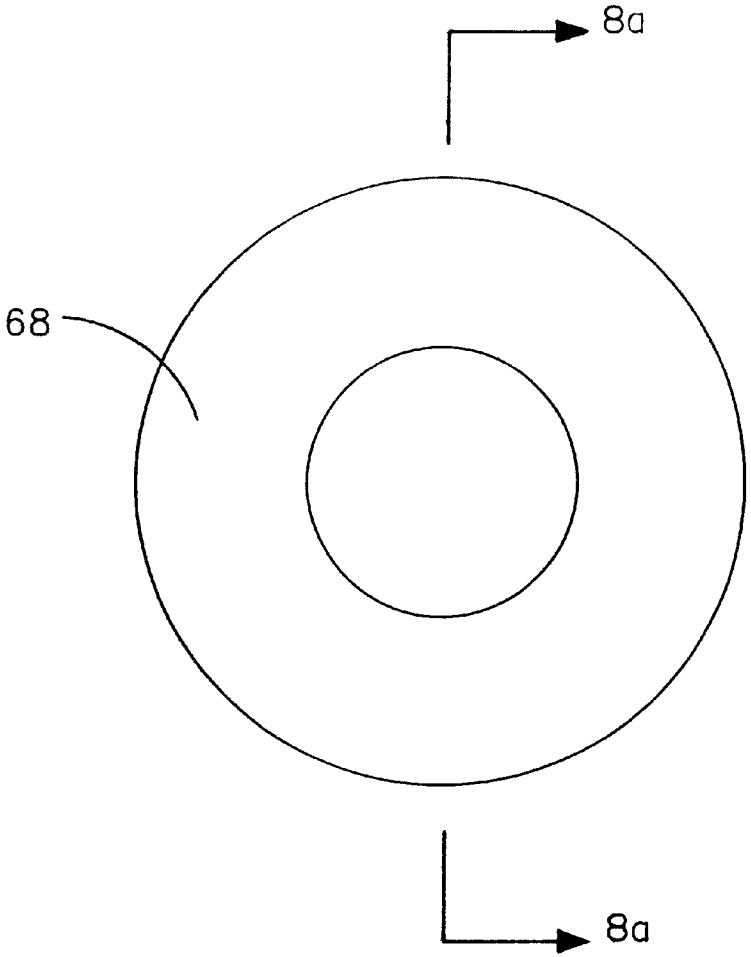
FIGS. 8*a* and 8*b* provide cross-sectional and front views of the socket support guide of the present invention.
Figure 8A:
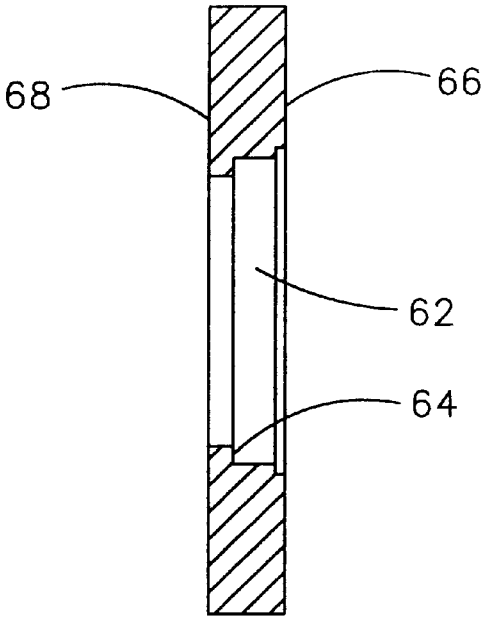

FIGS. 8*a* and 8*b* provide a lateral cross-section and an end elevational view, respectively, of the support guide. FIG. 8*a* shows the recess defining the flange seat within which the holding socket is held. FIG. 8*b* illustrates the flat rear surface 68 against which lock ring 55 presses.

When the transmission is operating normally, i.e. when it is not being adjusted, elements 51, 53, 57, and 59 are not present. Instead, there is a plastic cover (not shown) which is sandwiched between the lock rings 55 and 63. The plastic cover plays no role in the operation of the present invention, and therefore is not illustrated.

The operation of the apparatus of the present invention will now be described.

Before the adjustment can be made, one must remove the lock ring 55 and remove the plastic cover (not shown) that is held between lock rings 55 and 63. This step provides access to the internal components, such access being necessary to make the adjustment.

As a further preliminary step, one must select a support guide 57 which has the appropriate diameter. In practice, the present invention may be practiced with a kit which includes several such support guides, each having a different diameter, corresponding to different sizes of transmission casings.

Next, one takes the holding socket 59 and, while holding it such that the four lugs 61 face towards the right-hand side, in the view of FIG. 4, one slides the end of the holding socket having the two large, flat surfaces into the center bore of the support guide 57. The flange on the holding socket 59 contacts the corresponding flange seat 64 in the counter bore 62 of the front portion of the support guide 57.

When the holding socket 59 is correctly seated, the support guide 57 will have the two large flat surfaces 60 of the holding socket extending out from the back flat side 68 of the support guide 57. That is, the large flat surfaces 60 of the holding socket extend to the left, as shown in FIG. 4. The four extended square lugs 61 on the holding socket 59 still extend above the flat surface 66 on the front side of the support guide 57.

Next, one slides the assembly comprising support guide 57 and holding socket 59 into the servo piston bore in transmission casing 75. With the four extended square lugs 61 on the holding socket facing the servo piston 69, one matches the cutouts 71 in the servo piston with the lugs of the holding socket 59. One continues to slide the assembly into the servo piston bore until the four lugs engage the cutouts. The support guide must now seat flat against the lock ring 63. That is, the surface 66 of the support guide is parallel to the surface of the lock ring 63.

Next, one inserts lock ring 55 into the lock ring groove in the servo piston bore, in casing 75, thereby securely retaining the support guide 57 and the holding socket 59 in the casing. This will prevent the servo piston 69 from rotating and the lugs of the holding socket 59 from disengaging from the cutouts while the transmission adjustment is being made.

Next, one slides lock nut socket 53 into the center bore of holding socket 59, such that the two large flat surfaces of the lock nut socket face away from the holding socket. The internal hex end of the lock nut socket 53 (not visible in FIG. 4) faces into the holding socket 59, so that the internal hex end of lock nut socket 53 engages lock nut 67.

Holding the holding socket 59 stationary, preferably with a conventional wrench (not shown) engaged on its two large flat surfaces 60, will prevent the servo piston 69 from rotating. At the same time, with a conventional wrench (not shown) engaged on the two flat surfaces of lock nut socket 53, the lock nut 67 can be loosened or tightened without rotation of the servo piston 69. Unlike the arrangement of the prior art, in the present invention, one has a choice of how to position the handles of the wrenches, so it is possible to choose the position which is most convenient.

Next, one slides the adjusting tool 51 into the center of the lock nut socket 53, with the external hex head facing away from the lock nut socket 53 (i.e. to the left in FIG. 4). The internally-machined, round-cornered square end must face into the lock nut socket 53. The adjusting tool 51 engages servo apply pin 77 by non-threaded engagement. That is, the end of tool 51 simply fits over the square end of servo apply pin 77, and engages its four flat surfaces. Thus, rotating the adjusting tool 51 causes rotation of the servo apply pin 77. Note that the servo apply pin is still threaded into the servo piston, so it is still necessary to rotate the servo apply pin to move it longitudinally. The present invention differs, in one respect, from the prior art arrangement in that the adjusting tool 51 is not itself threaded onto the servo apply pin.

One uses a conventional wrench (not shown) to rotate the adjusting tool 51, by engaging the external hex head, shown at the left-hand side in FIG. 4, thereby adjusting the longitudinal position of the servo apply pin 77.

As described above, one may need three wrenches to hold the various elements (adjusting tool 51, lock nut socket 53, and holding socket 59. However, it is not necessary to use these wrenches simultaneously; at most, one may need to hold wrenches around lock nut socket 51 and holding socket 59 at the same time. When the servo apply pin has been adjusted to the desired position, one can hold adjusting tool 51 with one's fingers, and can manually thread lock nut socket 53 to thread lock nut 67 against servo piston 69. One would then use wrenches on lock nut socket 53 and holding socket 59 to lock the lock nut 67 against servo piston 69, thereby fixing the position of servo apply pin 77.

When the adjustment is complete, adjusting tool 51 and lock nut socket 53 are removed. Lock ring 55 is removed, so that support guide 57 and holding socket 59 can be withdrawn. Finally, the plastic cover (not shown) is returned to its original position, and the lock ring 55 is affixed over the cover.

The present invention therefore saves considerable time in adjusting an automatic transmission, as compared to methods of the prior art, because there is no need to affix a spanner wrench to the transmission. Also, the arrangement of the present invention can be practiced easily in the cramped environment of an automatic transmission. In particular, when a wrench is needed to prevent a component from rotating, the technician has a choice about how to orient the wrench. In the prior art, the semi-permanent affixation of the spanner wrench handle provided no choice about how to position that wrench.

The invention also includes a kit for adjusting an automatic transmission. At a minimum, the kit includes the holding socket and the support guide described above. The kit also preferably includes a lock nut socket and the adjusting tool made according to the present invention. In practice, the kit may include a set of holding sockets and support guides having various sizes, to accommodate different sizes of transmissions. In general, different transmissions have casings of varying diameters, so it is preferable to include, in the kit, at least a plurality of support guides to accommodate such variations.

Figure 10:
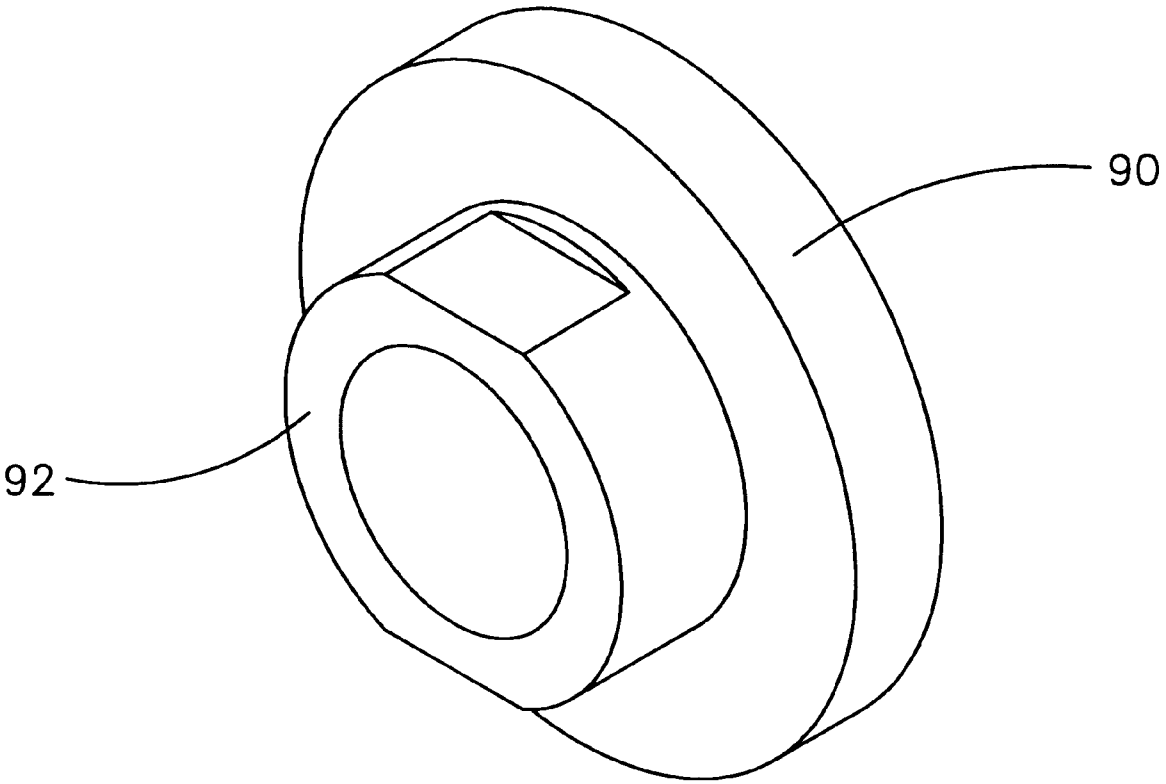
FIG. 10 provides a perspective view of an embodiment wherein the holding socket and support guide of the present invention are integrally formed.
Figure 11:
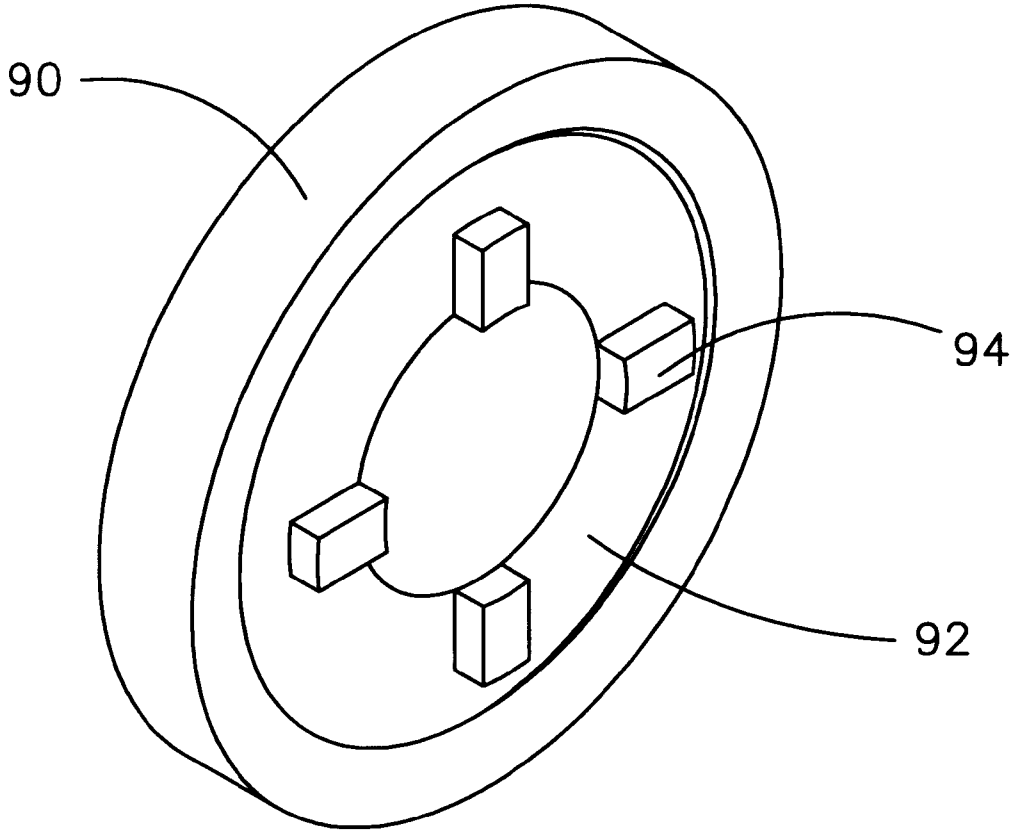
FIG. 11 provides a perspective view of the embodiment of FIG. 10, taken from the side which is not visible in FIG. 10, showing the lugs which are intended to engage cutouts in a servo piston.

In another embodiment, as illustrated in FIGS. 10 and 11, the holding socket and support guide are integrally formed.

FIG. 10 provides a perspective view of this one-piece structure. The large-diameter, outer flange 90 performs the function of the support guide, and the smaller-diameter structure 92 performs the function of the holding socket. The perspective view of FIG. 11 is taken from the opposite direction with respect to FIG. 10, and therefore shows the portion of the combined structure which is not visible in FIG. 10. FIG. 11 thus shows lugs 94 which perform in an identical manner to the lugs of the embodiment previously described.

When the invention is provided in the form of a kit, and the combined holding socket and support guide is used, it is preferable to include a plurality of such combined structures, of the type shown in FIGS. 10 or 11, wherein the various structures have large flanges of varying diameters. In general, it is more important to vary the diameter of the large flange than that of the small flange, because the variability in transmissions usually occurs with respect to the diameter of the casing.

Although the invention has been described with respect to the preferred embodiments, other modifications are possible. For example, the number of lugs and cutouts on the holding socket and servo piston can be varied. The number and orientation of flat surfaces, which can engage a conventional wrench, may also be varied. Also, as noted above, the invention is not necessarily limited to use with automatic transmissions, but may be used in other applications requiring adjustment of a threaded pin in a cramped environment. These and other modifications, which will be apparent to those skilled in the art, should be considered within the spirit and scope of the following claims.

What is claimed is:

1. In combination, an automatic transmission, the transmission including a servo piston threadedly connected to a servo apply pin, the servo piston and servo apply pin being contained within a casing, wherein the servo piston is in slidable contact with the casing, the servo piston including a plurality of cutouts, and the improvement comprising:

a holding socket having lugs which engage the cutouts of the servo piston, a support guide having means for engagement with the holding socket, the support guide having a central bore through which the holding socket passes, wherein the support guide fits within the casing, and locking means for containing the support guide within the casing.

2. The combination of claim 1, wherein the holding socket includes a plurality of flat surfaces, and wherein the flat surfaces protrude beyond the support guide when the holding socket is fully inserted into the central bore.

3. The combination of claim 1, wherein the support guide has a forward side having a recess which mates with a portion of the holding socket, and wherein the support guide has a rearward side which is substantially flat.

4. The combination of claim 1, wherein the servo apply pin has an end having a polygonal cross-section which is sized to mate with an adjusting tool which includes a polygonal internally machined recess.

5. The combination of claim 1, wherein the holding socket and the support guide are integrally formed.

* * * * *